US011649125B2

(12) United States Patent
Oshiro

(10) Patent No.: US 11,649,125 B2
(45) Date of Patent: May 16, 2023

(54) SHEET FEED DEVICE

(71) Applicant: TOSHIBA TEC KABUSHIKI KAISHA, Tokyo (JP)

(72) Inventor: Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 186 days.

(21) Appl. No.: 17/156,736

(22) Filed: Jan. 25, 2021

(65) Prior Publication Data

US 2022/0234849 A1 Jul. 28, 2022

(51) Int. Cl.

| | |
|---|---|
| ***B65H 3/52*** | (2006.01) |
| ***B65H 5/06*** | (2006.01) |
| ***B65H 7/02*** | (2006.01) |

(52) U.S. Cl.

CPC ..... *B65H 5/062* (2013.01); *B65H 3/523* (2013.01); *B65H 3/5207* (2013.01); *B65H 3/5215* (2013.01); *B65H 7/02* (2013.01); *B65H 2404/1441* (2013.01); *B65H 2515/10* (2013.01); *B65H 2515/32* (2013.01); *B65H 2515/34* (2013.01); *B65H 2515/805* (2013.01); *B65H 2701/1916* (2013.01); *B65H 2801/06* (2013.01)

(58) Field of Classification Search

CPC ..... B65H 3/5261; B65H 5/062; B65H 2515/10; B65H 2515/32; B65H 2515/805

See application file for complete search history.

(56) References Cited

U.S. PATENT DOCUMENTS 6,609,707 B1 8/2003 Yano
7,607,656 B2 * 10/2009 Yoshida ..... B65H 3/5261 271/124

FOREIGN PATENT DOCUMENTS

| | | |
|---|---|---|
| JP | 1045272 | 2/1998 |
| JP | 1191971 | 4/1999 |

* cited by examiner

*Primary Examiner* — Jeremy R Severson

(74) *Attorney, Agent, or Firm* — Amin, Turocy & Watson, LLP

(57) ABSTRACT

According to one embodiment, a sheet feed device includes a first roller, a second roller, a torque limiter, a holder, and a driving unit. The first roller conveys a sheet in a first direction while being in contact with a first surface of the sheet. The second roller faces the first roller and is in contact with a second surface which is a back side of the first surface of the sheet in a state of sandwiching the sheet between the second roller and the first roller. The torque limiter imparts an anti-torque to the second roller in order to generate a force on the second surface in a direction opposite to the first direction. The holder rotatably supports the second roller. The driving unit moves the holder and biases the holder toward the first roller.

12 Claims, 10 Drawing Sheets

SHEET FEED DEVICE

FIELD

Embodiments described herein relate generally to a sheet feed device, an image forming apparatus containing the sheet feed device, and methods related thereto.

BACKGROUND

There is a sheet feed device that sandwiches a sheet between a pair of rollers and conveys the sheet in a first direction. One of the pair of rollers is supported by a torque limiter. Even when two sheets are simultaneously conveyed between the pair of rollers, only one of the two sheets is conveyed downstream of the pair of rollers.

DETAILED DESCRIPTION

In general, according to one embodiment, the sheet feed device includes a first roller, a second roller, a torque limiter, a holder, and a driving unit. The first roller conveys a sheet in a first direction while being in contact with a first surface of the sheet. The second roller faces the first roller and is in contact with a second surface which is the back side of the first surface of the sheet in a state of sandwiching the sheet between the second roller and the first roller. The torque limiter imparts an anti-torque to the second roller in order to generate a force on the second surface in a direction opposite to the first direction. The holder rotatably supports the second roller. The driving unit moves the holder and biases the holder toward the first roller. According to another embodiment, a sheet feeding method involves conveying a sheet in a first direction by a first roller in contact with a first surface of the sheet and a second roller configured to face the first roller and contact with a second surface the sheet in a state of sandwiching the sheet between the second roller and the first roller; imparting an anti-torque to the second roller in order to generate a force on the second surface of the sheet in a direction opposite to the first direction; and a driver configured to moving a holder configured to rotatably support the second roller and biasing the holder toward the first roller.

Hereinafter, the sheet feed device according to the embodiment will be described with reference to the drawings.

First Embodiment

In the present embodiment, an example in which the sheet feed device is used in a sheet supply unit of image processing device will be described. The sheet feed device may be used in a manual feed tray of the image processing device, and the like.

Figure 1:
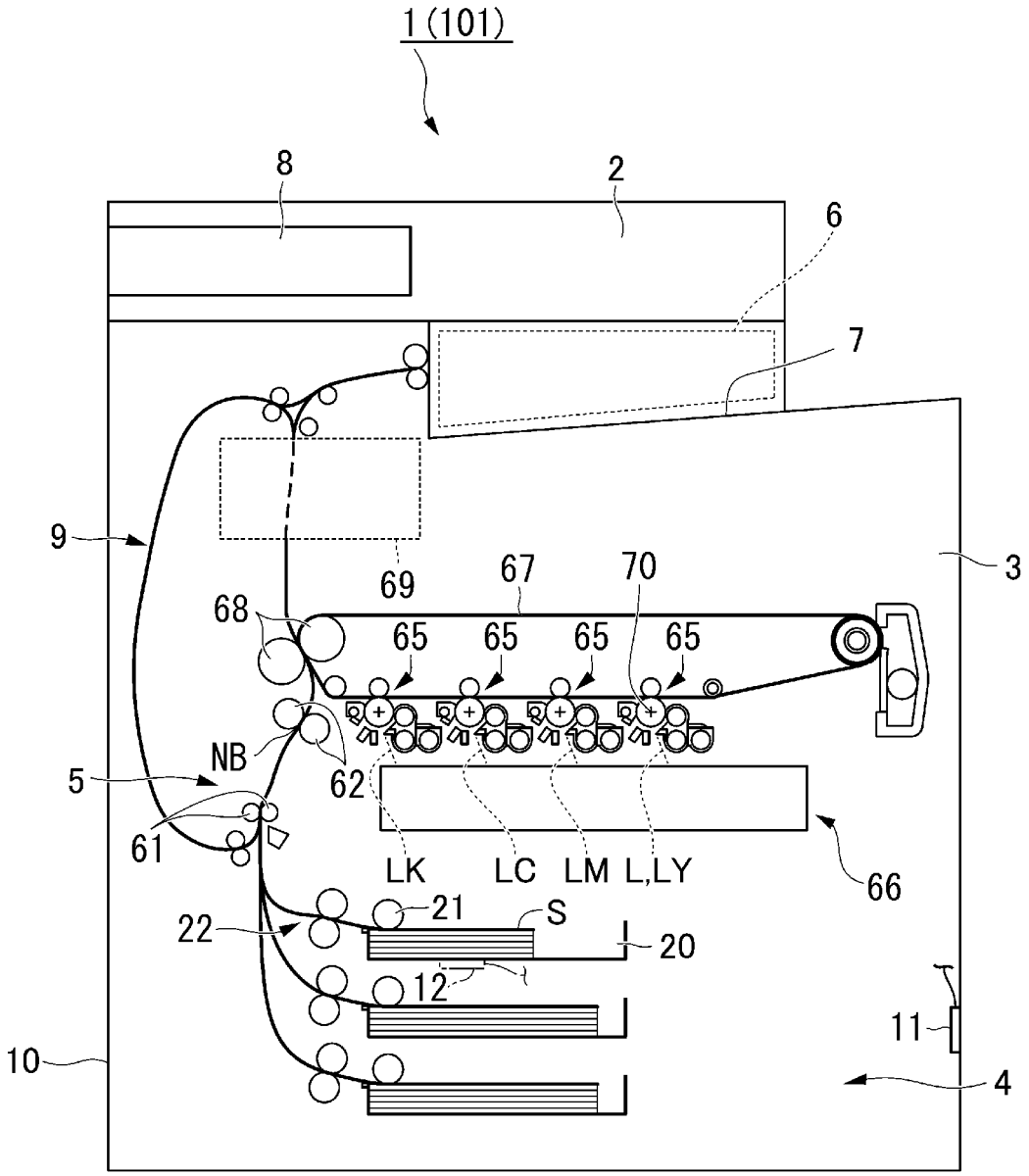
FIG. 1 is a schematic configuration diagram of an image forming apparatus according to a first embodiment.

FIG. 1 is a schematic configuration diagram of the image processing device according to the embodiment. The image processing device according to the embodiment is an image forming apparatus 1. The image forming apparatus 1 performs a process of forming an image on a sheet S.

The image forming apparatus 1 includes a housing 10, a scanner unit 2, an image forming unit 3, a sheet supply unit 4, a conveyance unit 5, a sheet feed tray 7, a reversing unit 9, a control panel 8, and a control unit 6.

The housing 10 forms the external appearance of the image forming apparatus 1. A humidity sensor 11 that detects the humidity of the air outside the image forming apparatus 1 is fixed to the housing 10. The humidity sensor 11 transmits the detection result to the control unit 6.

The scanner unit 2 reads image information to be copied based on brightness and darkness of light to generate an image signal. The scanner unit 2 outputs the generated image signal to the image forming unit 3.

The image forming unit 3 forms an output image using a recording agent such as a toner based on an image signal received from the scanner unit 2 or an image signal received from the outside. Hereinafter, an output image will be referred to as a toner image. The image forming unit 3 transfers a toner image onto the surface of a sheet S. The image forming unit 3 heats and pressurizes the toner image on the surface of the sheet S to fix the toner image onto the sheet S.

The sheet supply unit 4 supplies the sheets S to the conveyance unit 5 one by one in accordance with the timing at which the image forming unit 3 forms a toner image. The sheet supply unit 4 includes a sheet accommodation unit 20, a pick-up roller 21, and a sheet feed device 22.

The sheet accommodation unit 20 accommodates the sheets S of predetermined sizes and types.

The pick-up roller 21 picks up the sheets S one by one from the sheet accommodation unit 20. The sheet feed device 22 supplies the sheets S picked up by the pick-up roller 21 to the conveyance unit 5.

Figure 2:
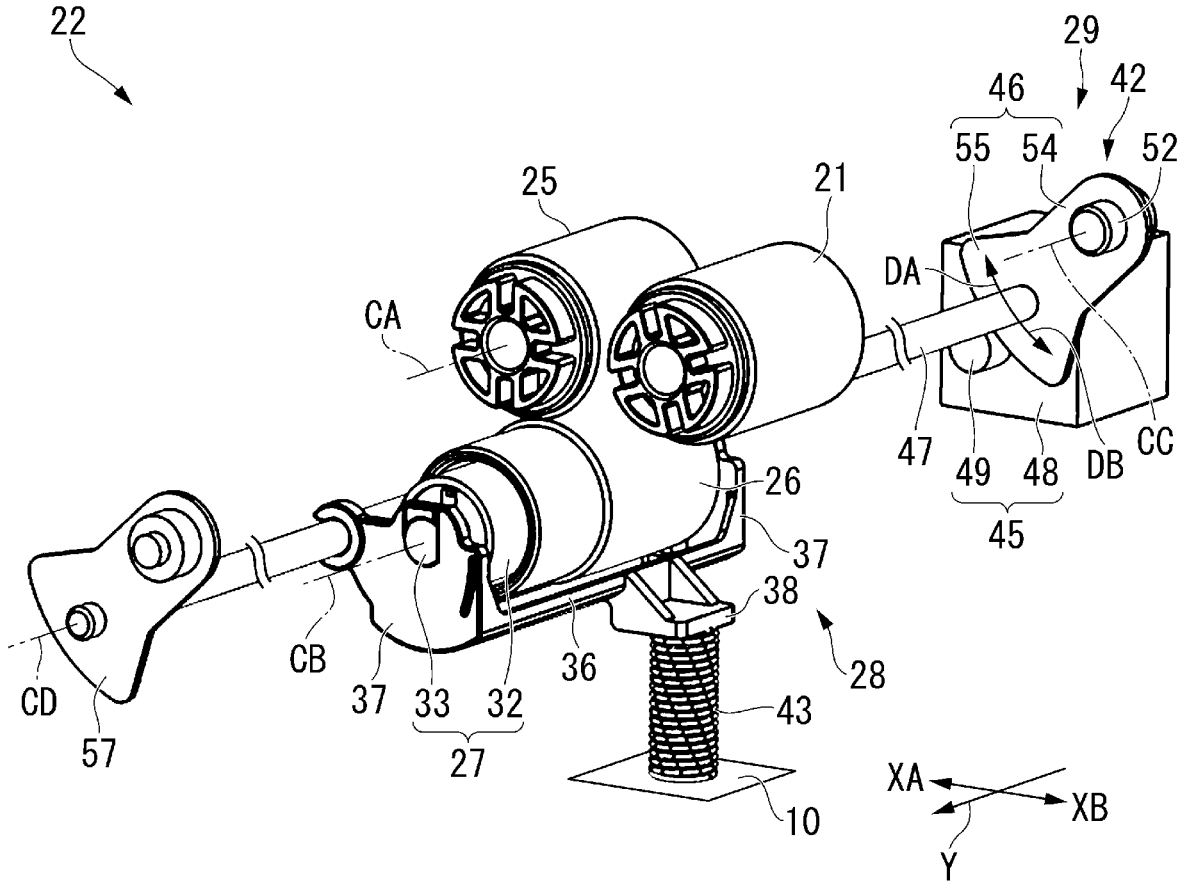
FIG. 2 is a perspective view of a sheet feed device according to the first embodiment.
Figure 3:
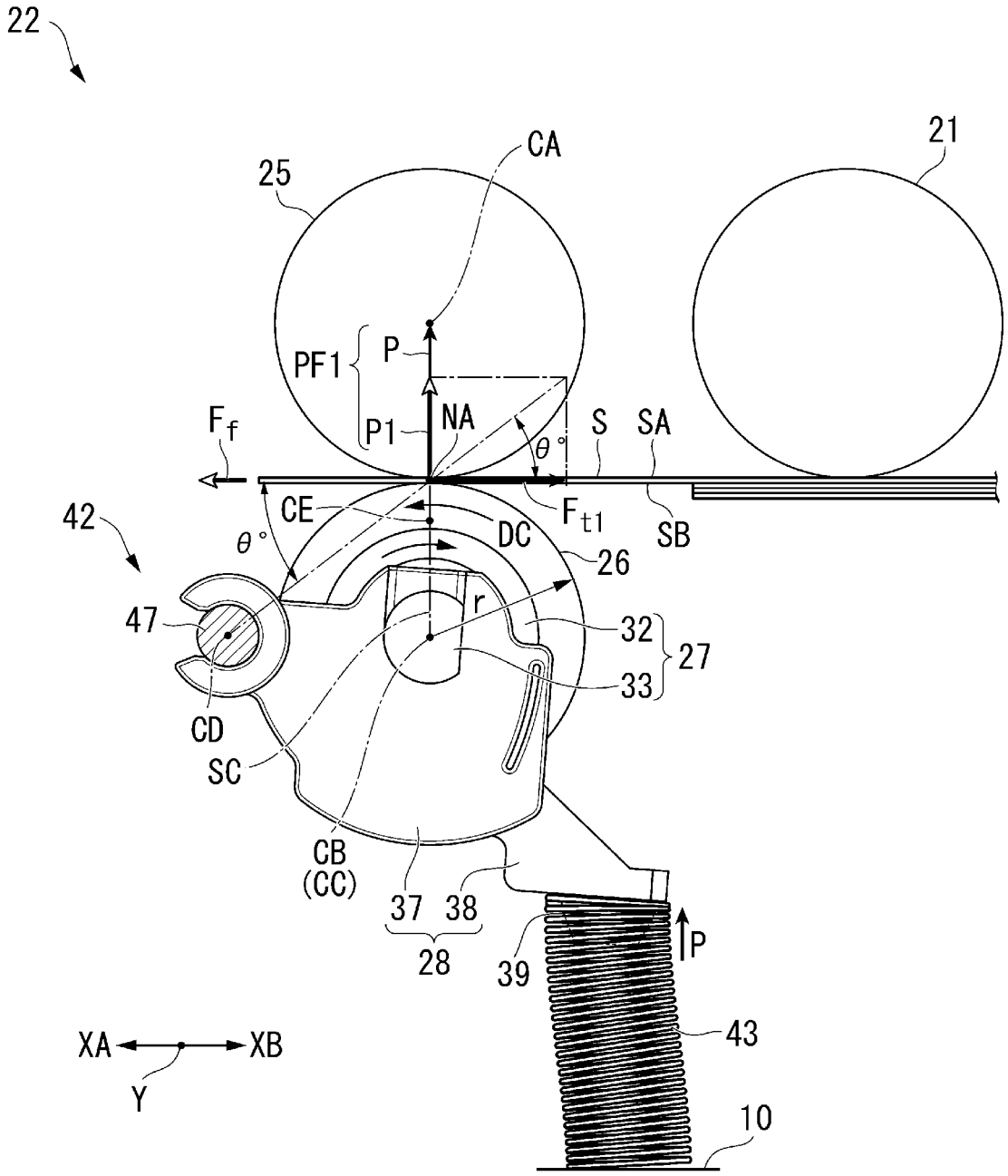
FIG. 3 is a front view when one sheet is conveyed to first and second rollers in the sheet feed device according to the first embodiment.

In the present embodiment, the description will be given on the assumption that a rotation shaft CB of a second roller 26 does not move even when a fulcrum angle θ changes according to the theory. As illustrated in FIGS. 2 and 3, the sheet feed device 22 includes a first roller 25, the second roller 26, a torque limiter 27, a holder 28, and a driving unit 29.

For example, the first roller 25 has a cylindrical shape. The first roller 25 is rotatably supported around a rotation shaft CA of the first roller 25 by a supporting member. For example, the first roller 25 is configured such that the rotation shaft CA is aligned with a horizontal plane. The first roller 25 conveys the sheet S in a first direction (the downstream side in the conveyance direction) XA while being in contact with a first surface SA of the sheet S. The direction opposite to the first direction XA will be referred to as a second direction (the upstream side in the conveyance direction) XB.

For example, the second roller 26 has a cylindrical shape. The second roller 26 faces the first roller 25 below the first roller 25. The second roller 26 is configured such that the rotation shaft CB of the second roller 26 is aligned with a horizontal plane. The second roller 26 sandwiches the sheet S together with the first roller 25. The nip formed between the first roller 25 and the second roller 26 will be referred to as a nip NA.

The second roller 26 is in contact with a second surface SB which is the back side of the first surface SA of the sheet S. The rotation shafts CA and CB have a length in a third direction Y perpendicular to the first direction XA. The third direction Y may be a direction intersecting the first direction XA.

For example, the torque limiter 27 is provided in the second roller 26. The torque limiter 27 is coaxial with the second roller 26. In the torque limiter 27, a support shaft 33 protrudes in the third direction Y with respect to a main body 32. If a torque having a value equal to or less than a threshold value determined in advance acts between the second roller 26 and the torque limiter 27, the torque limiter 27 is integrated with the second roller 26 and rotates around the rotation shaft CB. If a torque having a value exceeding the torque threshold value acts between the second roller 26 and the torque limiter 27, the torque limiter 27 slides against the second roller 26 to rotatably support the second roller 26 around the rotation shaft CB with an anti-torque equivalent to the torque threshold value. That is, the torque limiter 27 imparts an anti-torque to the second roller 26 in order to generate a force in the second direction XB on the second surface SB of the sheet S.

A torque exceeding the torque threshold value is a torque for rotating an end portion of the second roller 26 on the first roller 25 side in the first direction XA with respect to the torque limiter 27.

The torque limiter may not be coaxial with the second roller 26 as long as a torque can be cut off if an excessive torque acts on the second roller 26.

The holder 28 includes a main body 36, a pair of first support pieces 37, and a second support piece 38.

The main body 36 has a length in the third direction Y. The main body 36 is positioned below the second roller 26. The pair of first support pieces 37 has a length upward from each end portion of the main body 36 in the third direction Y. The support shaft 33 of the torque limiter 27 is fixed to each of the first support piece 37. The holder 28 rotatably supports the second roller 26.

Figure 4:
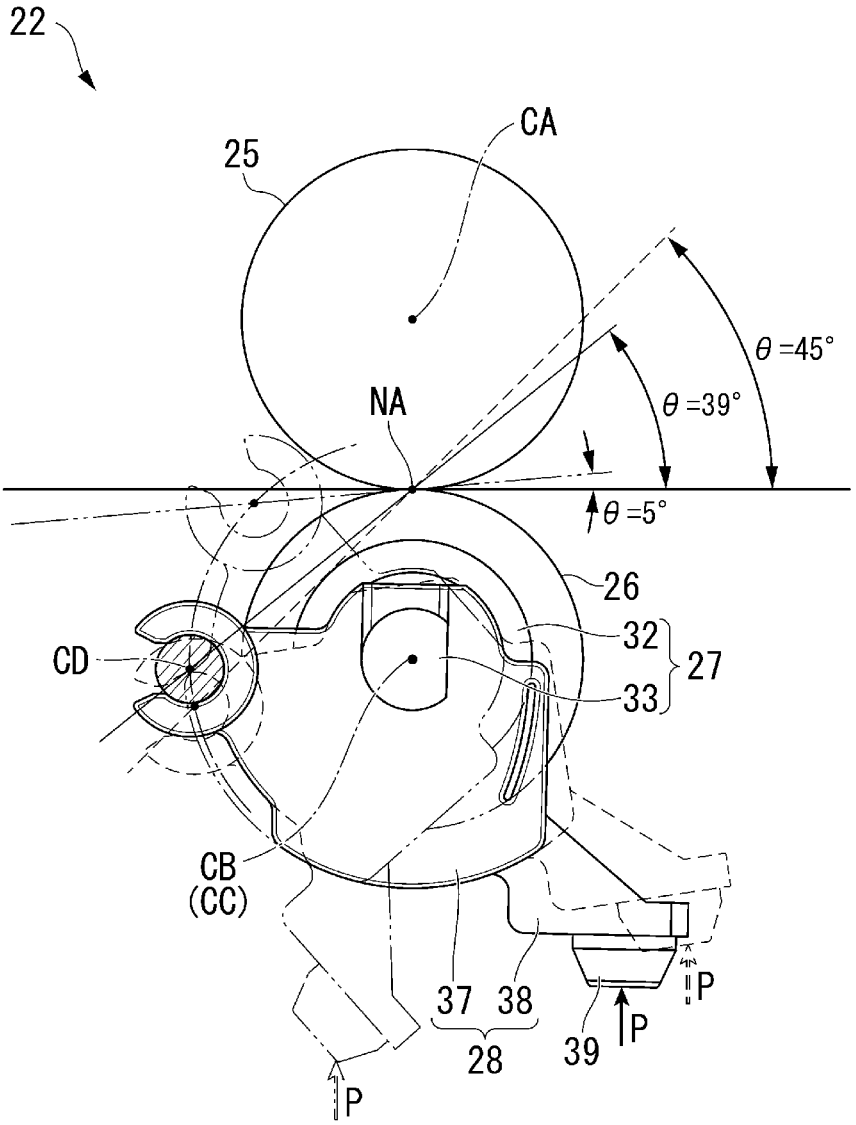
FIG. 4 is a front view in which states where a holder is rotated overlap each other in the sheet feed device according to the first embodiment.

The second support piece 38 is fixed to an intermediate portion of the main body 36 in the third direction Y. As illustrated in FIG. 4, a convex portion 39 is fixed to a lower surface of the second support piece 38. The convex portion 39 has a truncated conical shape.

The driving unit 29 rotates and moves the holder 28. The driving unit 29 biases the holder 28 toward the first roller 25. As illustrated in FIG. 2, the driving unit 29 includes a moving mechanism 42 and a biasing member 43. The moving mechanism 42 rotates and moves the holder 28. The moving mechanism 42 rotates the holder 28 around a first rotation shaft CC to move the holder 28. The moving mechanism 42 includes a motor 45, a cam 46, and a shaft 47.

A stepping motor or the like is used as the motor 45. The motor 45 includes a main body 48 and a driving shaft 49. The shaft member 52 is supported by the main body 48 to be rotatable around the first rotation shaft CC of the shaft member 52. A plurality of teeth are provided on the outer circumferential surface of the driving shaft 49.

The cam 46 includes a first portion 54 and a second portion 55. The first portion 54 has an elongated circular shape. The second portion 55 has a quadrantal shape. The second portion 55 is a portion different from the first portion 54 in the cam 46. A plurality of teeth are provided on a side surface having an arc shape in the second portion 55. The plurality of teeth are fitted to the plurality of teeth of the driving shaft 49 of the motor 45. An apex having an interior angle of approximately 90 degrees in the second portion 55 communicates with a first end portion of the first portion 54.

A central portion of the first portion 54 in the longitudinal direction is fixed to the shaft member 52. The first portion 54 of the cam 46 is supported by the motor 45 to be rotatable around the first rotation shaft CC.

The shaft 47 has a length in the third direction Y. Here, the central axis of the shaft 47 is referred to as a second rotation shaft CD.

The first end portion of the shaft 47 is fixed to the second portion 55 of the cam 46. A second end portion opposite to the first end portion in the shaft 47 is fixed to a second cam 57. The second cam 57 is supported by the housing 10 to be rotatable around the first rotation shaft CC. An intermediate portion of the shaft 47 in the third direction Y is connected to the first support piece 37 of the holder 28 to be rotatable around the second rotation shaft CD of the shaft 47. The holder 28 is rotatably connected to the second rotation shaft CD of the shaft 47. The second rotation shaft CD is a rotation shaft to which the holder 28 is directly connected. The holder 28 rotates around the shaft 47. The shaft 47 rotates around the first rotation shaft CC together with the cam 46.

As illustrated in FIGS. 2 and 3, for example, the shaft 47 is provided in the first direction XA with respect to the rotation shaft CB.

The first rotation shaft CC and the second rotation shaft CD of the moving mechanism 42 are rotation shafts if the moving mechanism 42 rotates and moves the holder 28. The moving mechanism 42 includes two rotation shafts CC and CD.

As illustrated in FIG. 3, the first rotation shaft CC is preferably formed coaxially with the rotation shaft CB of the second roller 26.

For example, the biasing member 43 is a helical spring.

A first end portion of the biasing member 43 is in contact with the second support piece 38 of the holder 28 from below the second support piece 38. The convex portion 39 is provided in the first end portion of the biasing member 43. A second end portion of the biasing member 43 is disposed on the housing 10.

The biasing member 43 generates a static pressing force P upward in the second support piece 38 of the holder 28. The biasing member 43 biases the holder 28 toward the first roller 25.

The biasing member may be a torsion spring or a weight.

Here, the operation of the sheet feed device 22 configured as described above will be described. When viewed along the rotation shaft CA of the first roller 25 and the rotation shaft CB of the second roller 26, the angle formed between a line connecting the second rotation shaft CD and the nip NA and the first direction XA and closer to the rotation shaft CB side of the second roller 26 than the first direction XA will be referred to as a fulcrum angle θ. The fulcrum angle θ can be referred to as an angle formed between the line and a direction from the nip NA toward the first direction XA and closer to the rotation shaft CB side than the first direction XA. For example, the fulcrum angle θ is 39° in a state indicated by a solid line in FIGS. 3 and 4.

If a voltage is applied to the motor 45 in a predetermined direction, the driving shaft 49 rotates in a predetermined direction with respect to the main body 48. As illustrated in FIG. 2, the cam 46 fitted to the driving shaft 49 rotates in a direction DA around the first rotation shaft CC. The driving shaft 49 of the motor 45 rotates the cam 46 around the first rotation shaft CC. For example, the holder 28 moves to a position indicated by an alternate two-dot chain line in FIG. 4. The fulcrum angle θ is 5°.

If a voltage is applied to the motor 45 in a direction opposite to the predetermined direction from a state indicated by a solid line in FIGS. 3 and 4, the driving shaft 49 rotates in the direction opposite to the predetermined direction with respect to the main body 48. As illustrated in FIG. 2, the cam 46 fitted to the driving shaft 49 rotates in a direction DB around the first rotation shaft CC. For example, the holder 28 moves to a position indicated by a dashed line in FIG. 4. The fulcrum angle θ is 45°.

The static pressing force P has substantially a fixed value regardless of the fulcrum angle θ due to the position of the biasing member 43 contacting the convex portion 39, or the like.

In the first embodiment, even when the fulcrum angle θ changes due to the holder 28 rotating around the first rotation shaft CC, the rotation shaft CB of the second roller 26 does not move.

As illustrated in FIG. 1, the conveyance unit 5 conveys the sheet S supplied from the sheet supply unit 4 to the image forming unit 3. The conveyance unit 5 includes conveyance rollers 61 and resist rollers 62.

The conveyance rollers 61 convey the sheet S supplied from the sheet feed device 22 to the resist rollers 62. The conveyance rollers 61 abut the leading end of the sheet S in the conveyance direction against a nip NB of the resist rollers 62.

The resist rollers 62 bend the sheet S in the nip NB to align the position of the leading end of the sheet S in the conveyance direction. The resist rollers 62 convey the sheet S in accordance with a timing at which the image forming unit 3 transfers a toner image onto the sheet S.

The image forming unit 3 will be described.

The image forming unit 3 includes a plurality of image forming portions 65, a laser scanning unit 66, an intermediate transfer belt 67, a transfer unit 68, and a fixing device 69.

Each of the image forming portions 65 includes a photoconductor drum 70. The image forming portion 65 forms a toner image corresponding to an image signal received from the scanner unit 2 or from the outside on a photoconductor drum 70. The plurality of image forming portions 65 form a toner image using yellow, magenta, cyan, and black toners, respectively.

A charger, a developing device, and the like are disposed around the photoconductor drum 70. The charger charges the surface of the photoconductor drum 70. The developing device stores a developer which contains toners of yellow, magenta, cyan, and black colors, respectively. The developing device develops an electrostatic latent image on the photoconductor drum 70. Toner images based on toners of respective colors are formed on the photoconductor drums 70.

The laser scanning unit 66 scans the charged photoconductor drums 70 with laser beams L to expose the photoconductor drums 70. The laser scanning unit 66 exposes the photoconductor drums 70 of the image forming portions 65 of the respective colors by different laser beams LY, LM, LC, and LK. The laser scanning unit 66 forms electrostatic latent images on the photoconductor drums 70.

The toner images on the surfaces of the photoconductor drums 70 are primarily transferred onto the intermediate transfer belt 67.

The transfer unit 68 transfers the toner image primarily transferred onto the intermediate transfer belt 67 onto the surface of the sheet S at a secondary transfer position.

The fixing device 69 heats and pressurizes the toner image transferred onto the sheet S to fix the toner image to the sheet S.

The reversing unit 9 reverses the sheet S in order to form an image on the back surface of the sheet S. The reversing unit 9 reverses the front and back of the sheet S discharged from the fixing device 69 through switching back. The reversing unit 9 conveys the reversed sheet S toward the resist rollers 62.

The sheet feed tray 7 places the discharged sheet S on which an image was formed.

The control panel 8 is a portion of an input unit that inputs information for an operator to operate the image forming apparatus 1. The control panel 8 includes a touch panel and various hardware keys.

The control unit 6 controls each portion of the image forming apparatus 1.

Figure 5:
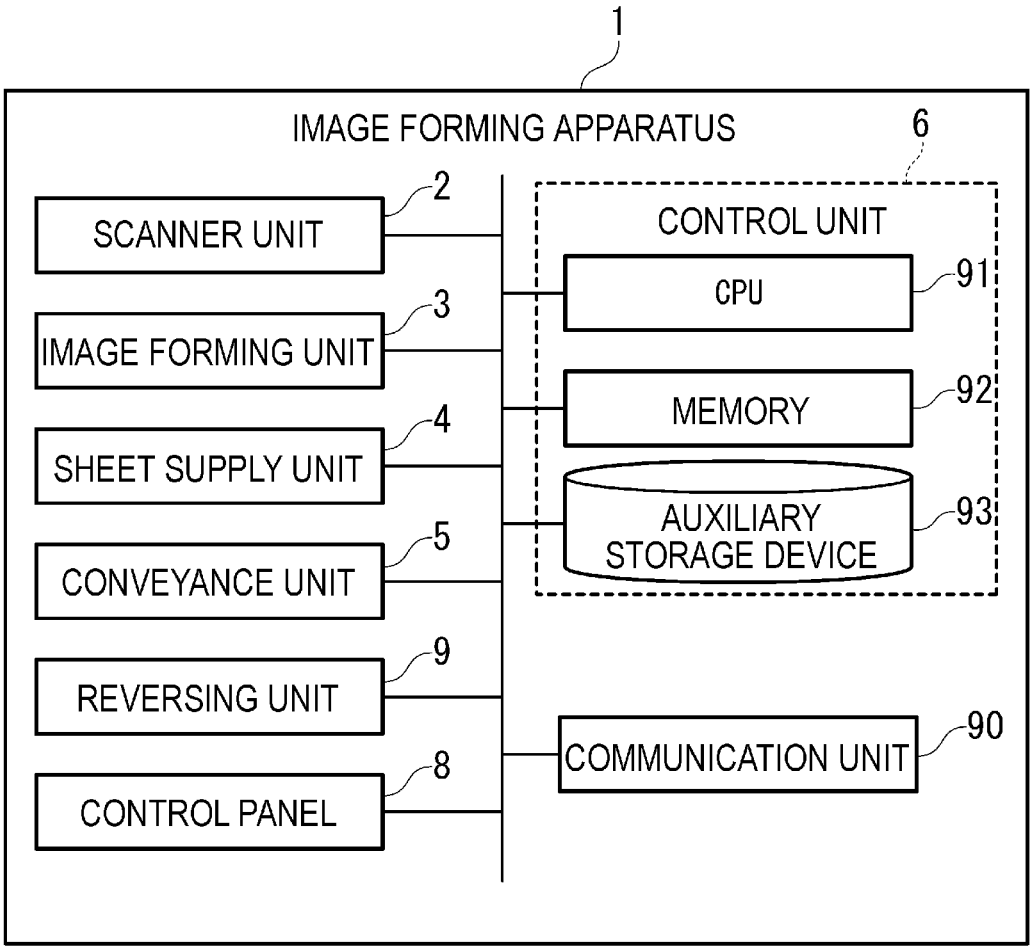
FIG. 5 is a hardware configuration diagram of the image forming apparatus according to the first embodiment.

FIG. 5 is a hardware configuration diagram of the image forming apparatus 1 according to the embodiment. The image forming apparatus 1 includes a central processing unit (CPU) 91, a memory 92, an auxiliary storage device 93, and the like that are connected to each other through a bus and executes programs. The image forming apparatus 1 functions as a device that includes the scanner unit 2, the image forming unit 3, the sheet supply unit 4, the conveyance unit 5, the reversing unit 9, the control panel 8, and a communication unit 90 by executing the programs.

The CPU 91 functions as the control unit 6 by executing programs stored in the memory 92 and the auxiliary storage device 93. The control unit 6 controls the operation of the respective functional units of the image forming apparatus 1. Specifically, the control unit 6 controls the driving unit 29 based on detection results obtained by the humidity sensor 11.

The auxiliary storage device 93 is configured using a storage device such as a magnetic hard disk device or a semiconductor storage device. The auxiliary storage device 93 stores information. The auxiliary storage device 93 stores a humidity threshold value determined in advance, and the like.

The communication unit 90 is configured to include a communication interface for connecting the image forming apparatus 1 to an external device. The communication unit 90 communicates with the external device through the communication interface.

A mechanism in which the sheet supply unit 4 supplies one sheet S will be described.

As illustrated in FIG. 3, the radius of the outer circumferential surface of the second roller 26 is set to be "r". For example, the unit of the radius "r" is "cm". A torque threshold value of the torque limiter 27 is set to be "TL". For example, the unit of the torque threshold value "TL" is "cN·m (centinewton meter)". For example, the torque threshold value is a value equal to or greater than 2.94 cN·m and equal to or less than 4.9 cN·m.

A returning force in the second direction XB which is generated by the torque limiter 27 is set to be "$F_{tl}$". For example, the unit of the returning force $F_{tl}$ is "N". For example, the unit of the static pressing force P is "N".

A case where one sheet S is conveyed to the first roller 25 and the second roller 26 as illustrated in FIG. 3 will be described.

The returning force $F_{tl}$ is obtained by Equation (1).

$$F_{tl}=TL/r \quad (1)$$

The rotating force around the second rotation shaft CD which is generated by the returning force $F_{tl}$ of the torque limiter 27 when one sheet S was conveyed is set to be "P1". For example, the unit of the rotating force P1 is "N".

In this case, the rotating force P1 is obtained by Equation (2).

$$P1=F_{tl}\times\tan\theta \quad (2)$$

The dynamic pressing force PF1 when one sheet S is conveyed is obtained by Equation (3). The dynamic pressing force PF1 is a force acting perpendicularly to the sheet S.

$$PF1 = F_{t1}\times\tan\theta + P = P1 + P \quad (3)$$

A static friction coefficient between the first roller 25 and the sheet S is set to be "$\mu_f$". The conveying force $F_f$ of the first roller 25 is obtained by Equation (4).

$$F_f=\mu_f\times P \quad (4)$$

The condition that one sheet S is conveyed in the first direction XA from the first roller 25 and the second roller 26 is obtained by Equation (5).

$$F_f>F_{tl} \quad (5)$$

In this case, the torque limiter 27 slides. The second roller 26 rotates in a direction DC around the rotation shaft CB with respect to the torque limiter 27. Since the second roller 26 is supported by the torque limiter 27, the holder 28 rotates around the second rotation shaft CD. The second roller 26 is pressed against the sheet S side and the dynamic pressing force PF1 in which the second roller 26 bites into the first roller 25 is generated. The dynamic pressing force PF1 is also a biting force. The sheet S and the second roller 26 rotate together and one sheet S is conveyed in the first direction XA from the first roller 25 and the second roller 26.

For example, if the static friction coefficient $\mu_f$ is reduced, the conveying force $F_f$ is decreased. Equation (5) is not satisfied, and thus there is a concern that a conveyance defect of the sheet S may occur. In this case, the dynamic pressing force PF1 is increased by increasing the fulcrum angle θ. Equation (5) is satisfied, and thus the concern that a conveyance defect of the sheet S may occur is removed.

Figure 6:
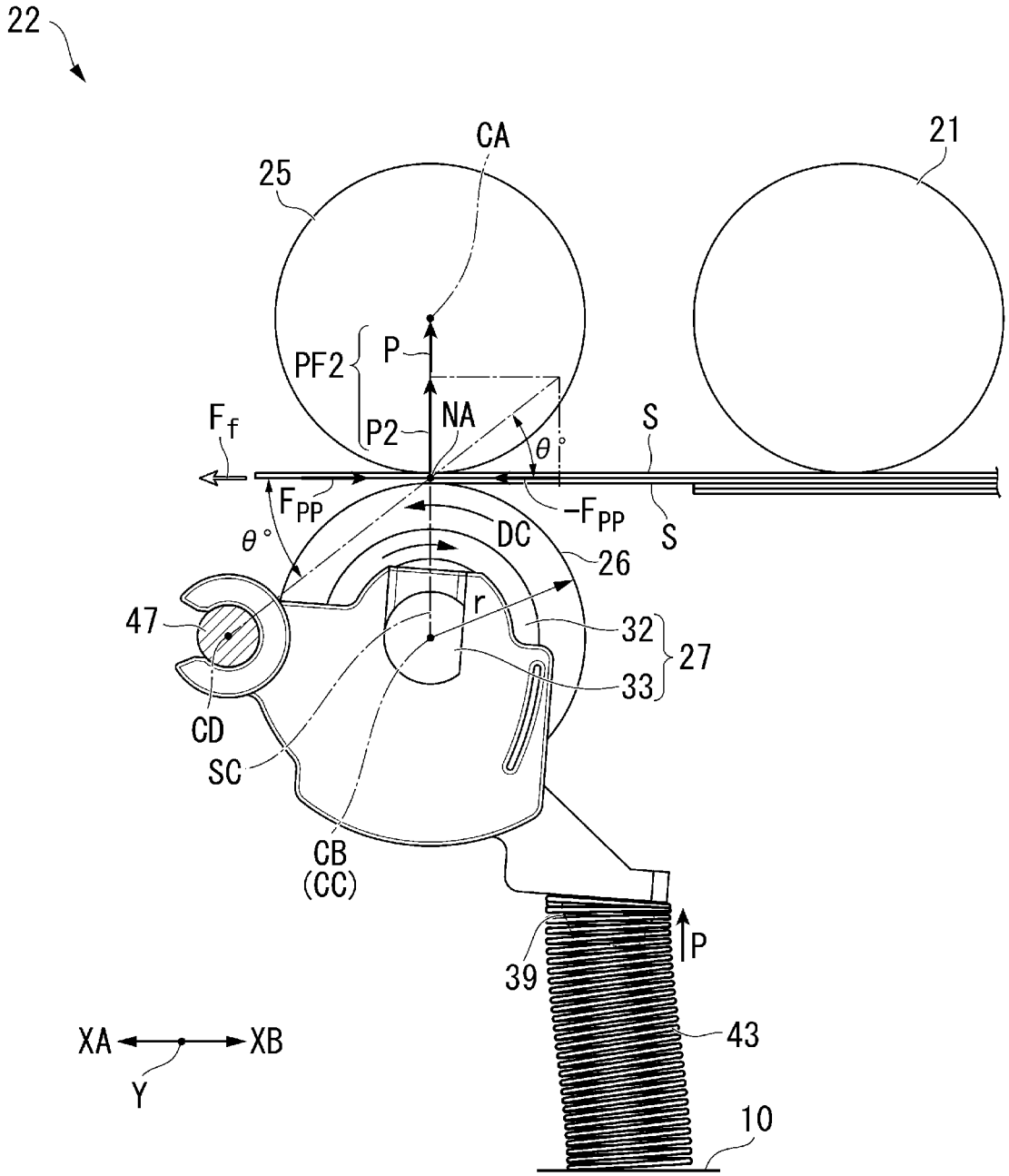
FIG. 6 is a front view when two sheets are conveyed to the first and second rollers in the sheet feed device according to the first embodiment.

As illustrated in FIG. 6, a case where two sheets S are conveyed to the first roller 25 and the second roller 26 will be described.

The static friction coefficient between the sheets S is set to be "$\mu_{pp}$". The returning force generated by the static friction coefficient $\mu_{pp}$ and the static pressing force P is set to be "$F_{pp}$". The returning force $F_{pp}$ is obtained by Equation (11).

$$F_{pp}=\mu_{pp}\times P \quad (11)$$

The rotating force around the second rotation shaft CD which is generated by the static friction coefficient $\mu_{pp}$ and the static pressing force P when two sheets S were conveyed is set to be "P2".

The rotating force P2 is obtained by Equation (12).

$$P2=F_{pp}\times\tan\theta \quad (12)$$

The dynamic pressing force PF2 when two sheets S are conveyed is obtained by Equation (13). The dynamic pressing force PF2 is a force acting perpendicularly to the sheet S.

$$PF2 = F_{pp}\times\tan\theta + P = P2 + P \quad (13)$$

The condition that one sheet S is conveyed in the first direction XA from the first roller 25 and the second roller 26 is obtained by Equation (14) and Equation (15).

$$F_{tl}>F_{pp} \quad (14)$$

$$F_f>-F_{pp} \quad (15)$$

When Equation (14) is satisfied, the torque limiter 27 does not slide. The second roller 26 rotates in the direction DC around the rotation shaft CB with respect to the torque limiter 27. Also, in this case, the dynamic pressing force PF2 in which the second roller 26 bites into the first roller 25 is generated. The end of the lower sheet S in the first direction XA stops at the nip NA. The lower sheet S is separated from the upper sheet S. When Equation (15) is satisfied, the upper sheet S is conveyed in the first direction XA from the first roller 25 and the second roller 26.

The returning force $F_{pp}$ may be increased due to characteristics of the sheet S such as the rigidity of the sheet S, the static friction coefficient $\mu_{pp}$, and the smoothness of the sheet S, and the environment such as humidity. In this case, Equation (14) is not satisfied, and thus the torque limiter 27 slides, which leads to a concern that the lower sheet S may be conveyed in the first direction XA.

In this case, the dynamic pressing force PF2 is decreased by reducing the fulcrum angle θ. Equation (14) is satisfied, and thus the torque limiter 27 does not slide. A concern that a conveyance defect of the sheet S may occur is removed.

Figure 7:
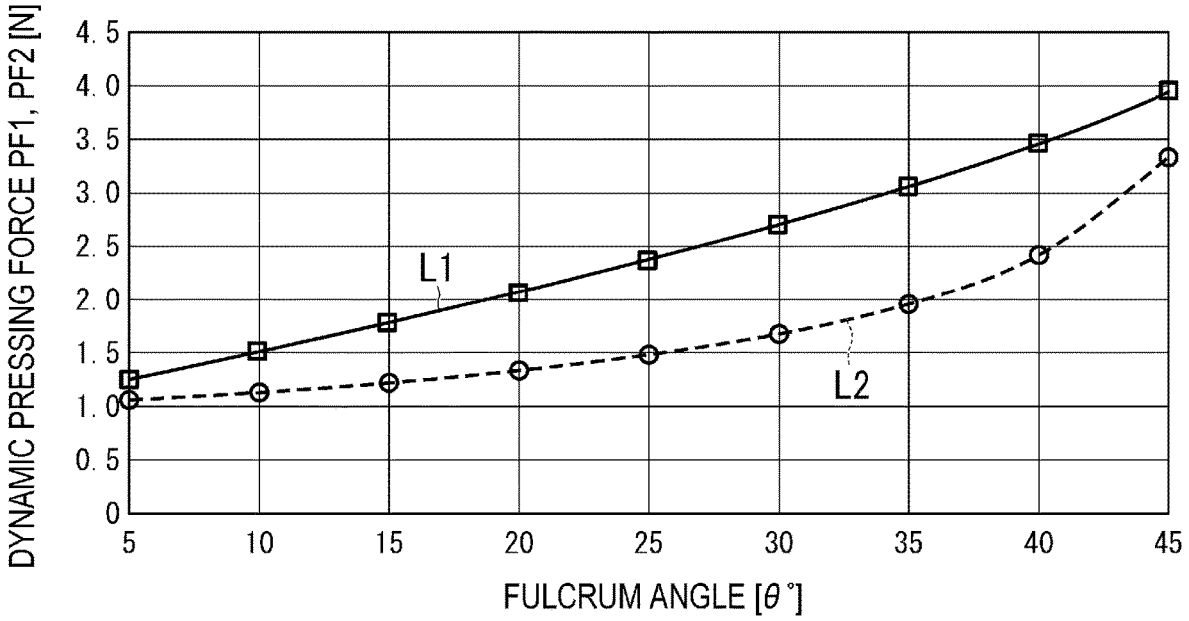
FIG. 7 is a diagram illustrating changes in a dynamic pressing force with respect to the fulcrum angle in the sheet feed device according to the first embodiment.

Results obtained by measuring the dynamic pressing forces PF1 and PF2 through experiments are illustrated in FIG. 7. In FIG. 7, the horizontal axis represents the fulcrum angle θ and the vertical axis represents the dynamic pressing forces PF1 and PF2. The curve L1 represents the dynamic pressing force PF1 if one sheet S is conveyed. The curve L2 represents the dynamic pressing force PF2 if two sheets S are conveyed. The curve L2 is the dynamic pressing force PF2 for the upper sheet S. The fulcrum angle θ is changed from 5° to 45°.

With respect to each of the dynamic pressing forces PF1 and PF2, the dynamic pressing forces PF1 and PF2 increase gradually as the fulcrum angle θ becomes larger. The dynamic pressing force PF1 is greater than the dynamic pressing force PF2 with respect to a fixed fulcrum angle θ. If the dynamic pressing force PF1 changes, the conveyance force $F_f$ for conveying the sheet S in the first direction XA also changes. If the dynamic pressing force PF2 changes, the conveyance force $F_f$ for conveying the upper sheet S in the first direction XA changes.

In the image forming apparatus 1, if the detection result obtained by the humidity sensor 11 exceeds a humidity threshold value, the control unit 6 rotates and moves the holder 28 by the driving unit 29 so that the fulcrum angle θ becomes smaller.

As described above, in the sheet feed device 22 of the present embodiment, the driving unit 29 biases the holder 28 toward the first roller 25, and thus the sheet S can be reliably sandwiched between the first roller 25 and the second roller 26. If the driving unit 29 rotates and moves the holder 28, the fulcrum angle θ changes, and the dynamic pressing force PF2 changes. It is possible to prevent two sheets from being conveyed at once in the first direction XA from the first roller 25 and the second roller 26 by appropriately adjusting the dynamic pressing force PF2.

The driving unit 29 includes the moving mechanism 42 and the biasing member 43. The movement of the holder 28 and the biasing of the holder 28 toward the first roller 25 can be performed separately by the moving mechanism 42 and the biasing member 43.

The moving mechanism 42 rotates the holder 28. The rotation can be easily performed using a rotation shaft of a general motor, or the like, as compared with the parallel movement.

The first rotation shaft CC when the moving mechanism 42 rotates and moves the holder 28 is coaxial with the rotation shaft CB of the second roller 26. Even when the holder 28 rotates around the first rotation shaft CC, it is possible to suppress a change in the position of the nip NA due to the movement of the rotation shaft CB of the second roller 26.

The moving mechanism 42 includes the motor 45, the cam 46, and the shaft 47. The holder 28 can be rotated and moved with a simple configuration including the motor 45, the cam 46, and the shaft 47.

The motor 45 includes the driving shaft 49 that rotates the cam 46 around the first rotation shaft CC. The cam 46 can be rotated around the first rotation shaft CC without using a gear and the like other than the motor 45 and the cam 46.

In the image forming apparatus 1 of the present embodiment, it is possible to configure the image forming apparatus 1 by using the sheet feed device 22 in which two sheets S are prevented from being conveyed at once in the first direction XA from the first roller 25 and the second roller 26.

The image forming apparatus 1 includes the humidity sensor 11 and the control unit 6. If the detection result obtained by the humidity sensor 11 exceeds a humidity threshold value, the driving unit 29 can rotate and move the holder 28 so that the fulcrum angle θ becomes smaller. If the fulcrum angle θ becomes smaller, the dynamic pressing force PF2 is reduced. Thus, if two sheets S are conveyed, the two sheets S can be easily separated from each other.

The configurations of the sheet feed device 22 and the image forming apparatus 1 of the present embodiment can be modified in various ways as described below.

As illustrated in FIG. 3, a first rotation shaft CE when the moving mechanism 42 rotates and moves the holder 28 may be positioned on a reference surface SC including the rotation shaft CA of the first roller 25 and the rotation shaft CB of the second roller 26. For example, the first rotation shaft CE is positioned between the rotation shaft CA and the rotation shaft CB except for the rotation shafts CA and CB on the reference surface SC.

According to such a configuration as in the modification, if the holder 28 rotates around the first rotation shaft CE, it is possible to suppress a change in the position of the nip NA due to the movement of the rotation shaft CB of the second roller 26 within a fixed range.

As illustrated in FIG. 1, an image forming apparatus 101 may include a mass sensor 12 that detects the mass of the sheet S. In this case, an auxiliary storage device 93 of the control unit 6 may store a mass threshold value determined in advance, and the like. The control unit 6 controls the driving unit 29 based on the detection result obtained by the mass sensor 12.

For example, the image forming apparatus 101 of the present modification example is used to form an image on the sheet S having a large thickness and a relatively large mass. The mass sensor 12 may be a timer that measures the time required for the sheet S to move through a predetermined conveyance path. This is because the time required for the sheet S to move through a predetermined conveyance path generally increases as the mass of the sheet S increases.

The control unit 6 in the image forming apparatus 101 rotates and moves the holder with the driving unit 29 so that the fulcrum angle θ becomes larger if the detection result obtained by the mass sensor 12 exceeds the mass threshold value. Since the dynamic pressing force PF2 increases if the fulcrum angle θ becomes larger, the sheet S can be reliably conveyed in the first direction XA from the first roller 25 and the second roller 26 even when the mass of the sheet S is relatively large.

Second Embodiment

In the present embodiment, the description will be given on the assumption that the rotation shaft CB of the second roller 26 is moved if the fulcrum angle θ changes as in a sheet feed device of an actual machine.

Figure 8:
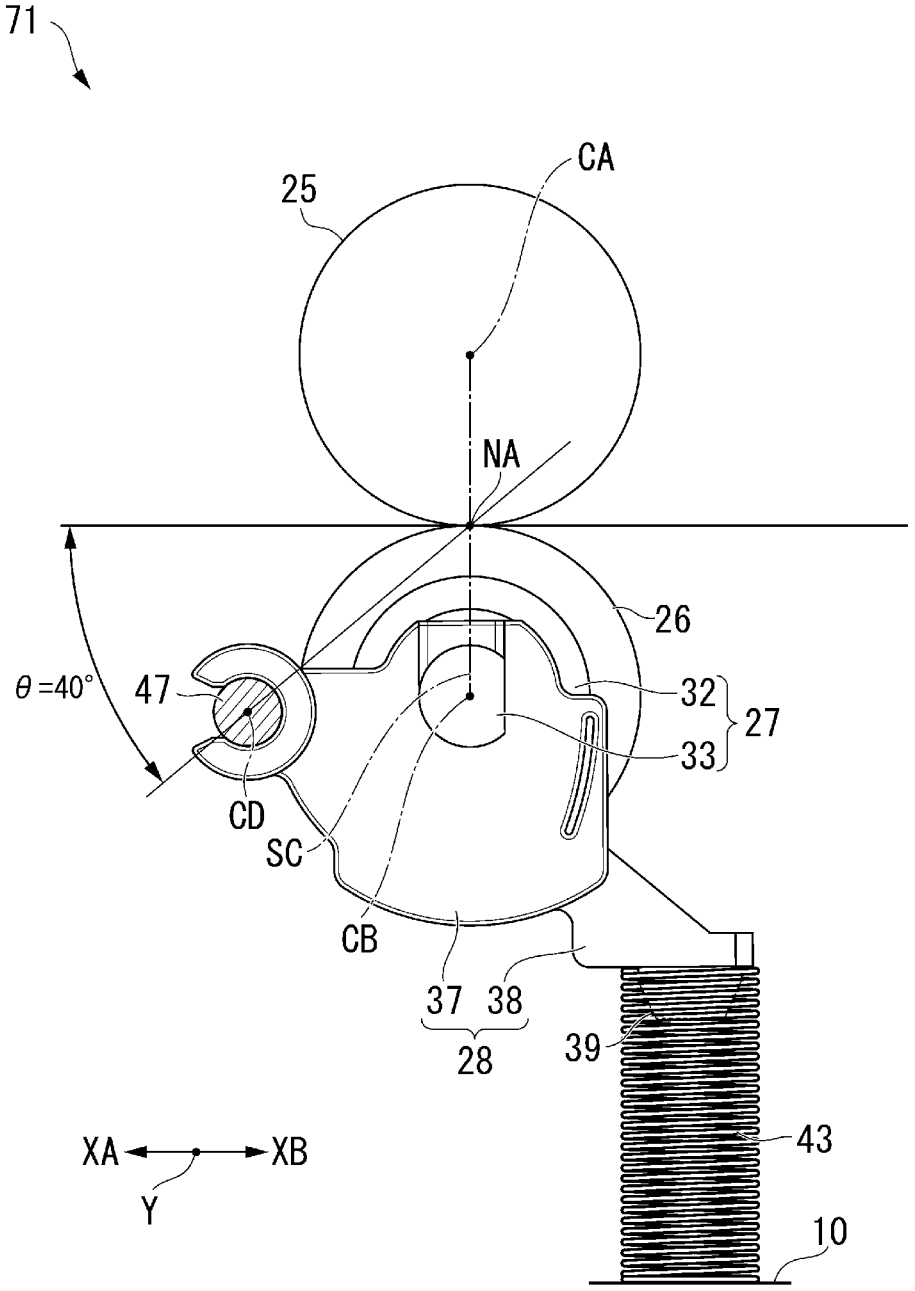
FIG. 8 is a front view when the fulcrum angle is 40° in a sheet feed device according to a second embodiment.

In a sheet feed device 71 illustrated in FIG. 8, unlike the sheet feed device 22 of the first embodiment, the first rotation shaft is disposed at a position different from the rotation shaft CB of the second roller 26. The position of the first rotation shaft changes complicatedly due to components of the image forming apparatus.

FIG. 8 illustrates a state where a fulcrum angle θ is 40° in the sheet feed device 71. In this state, the nip NA is positioned on the reference surface SC.

Figure 9:
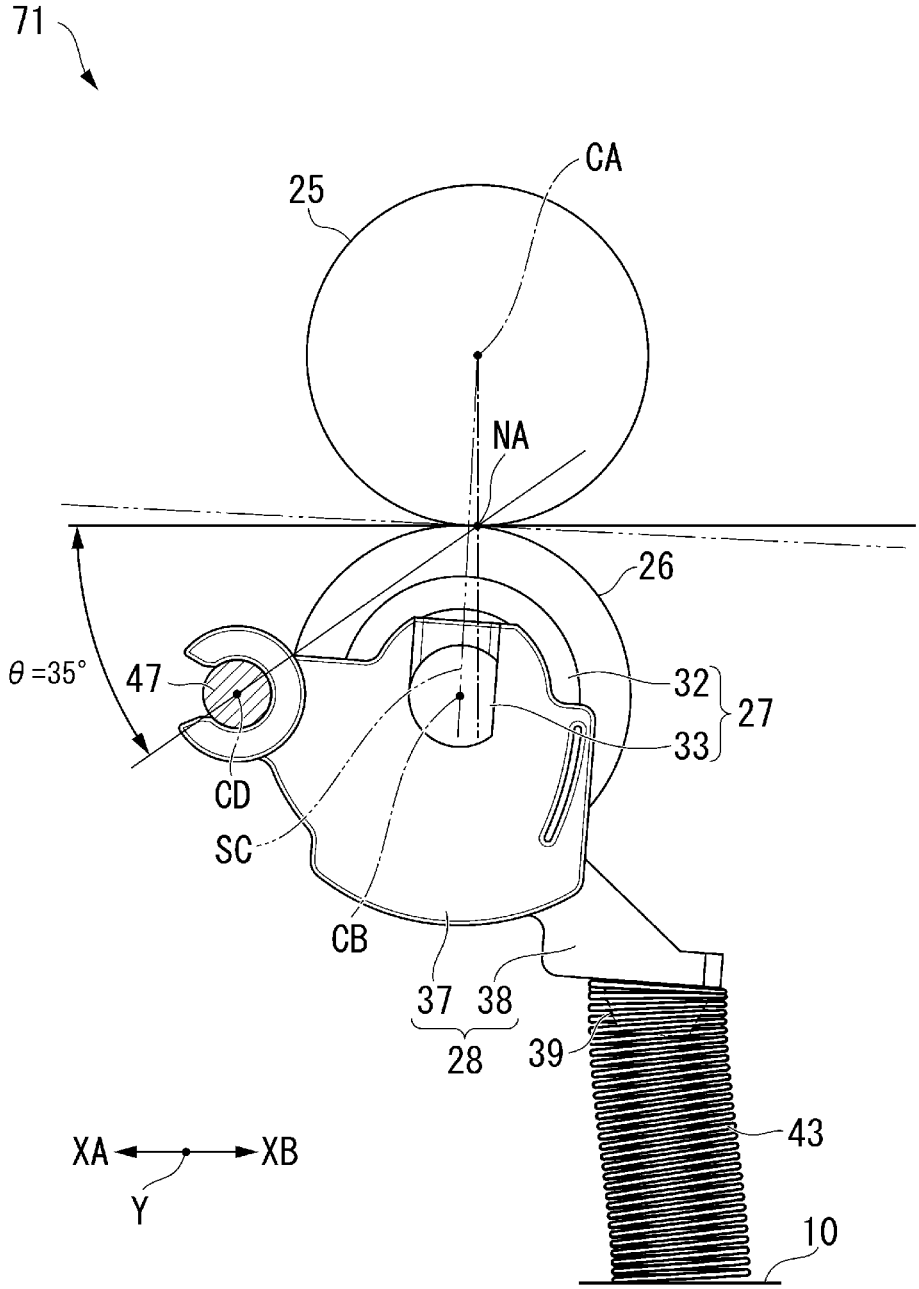
FIG. 9 is a front view when the fulcrum angle is 35° in the sheet feed device according to the second embodiment.

FIG. 9 illustrates a state where a fulcrum angle θ is 35° in the sheet feed device 71. In this state, the nip NA is positioned in the second direction XB with respect to the reference surface SC.

Figure 10:
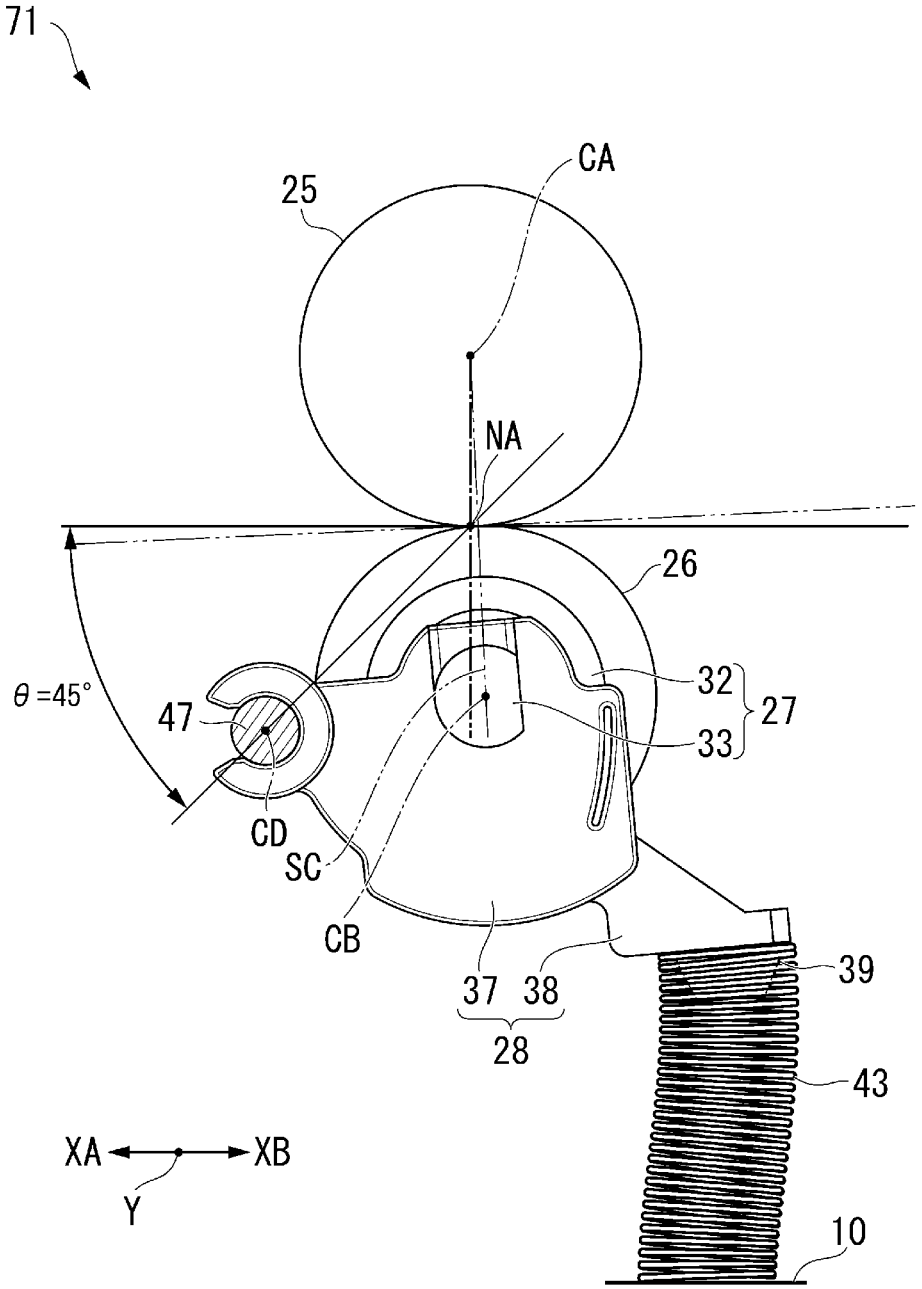
FIG. 10 is a front view when a fulcrum angle is 45° in the sheet feed device according to the second embodiment.

FIG. 10 illustrates a state where a fulcrum angle θ is 45° in the sheet feed device 71. In this state, the nip NA is positioned in the first direction XA with respect to the reference surface SC.

Also in the sheet feed device 71 configured in this manner, it can be understood that the dynamic pressing force changes if the fulcrum angle θ changes.

Also in the sheet feed device 71 according to the second embodiment, it is also possible to exhibit the same effects as those in the sheet feed device 22 according to the first embodiment.

In the first and second embodiments and the modification, the moving mechanism may be a mechanism that moves the holder 28 in parallel.

An image processing device is configured as the image forming apparatus 1. The image processing device may be a device that forms an image on the sheet S using a decolorable toner.

The image processing device is configured to include the control unit 6 but the sheet feed device 71 may be configured to include the control unit 6.

According to at least one of the above-described embodiments, two sheets S can be prevented from being conveyed at once in the first direction XA from the first roller 25 and the second roller 26 by including the driving unit 29.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet feed device, comprising:

a first roller configured to convey a sheet in a first direction while being in contact with a first surface of the sheet;

a second roller configured to face the first roller and contact with a second surface the sheet in a state of sandwiching the sheet between the second roller and the first roller;

a torque limiter configured to impart an anti-torque to the second roller in order to generate a force on the second surface of the sheet in a direction opposite to the first direction;

a holder configured to rotatably support the second roller; and a driver configured to move the holder and bias the holder toward the first roller, wherein the driver comprises a moving mechanism that moves the holder, and a biasing member that biases the holder toward the first roller, wherein the moving mechanism rotates the holder around a first rotation shaft to move the holder, and wherein the first rotation shaft is positioned on a reference surface comprising a rotation shaft of the first roller and a rotation shaft of the second roller.

2. A sheet feed device, comprising:

a first roller configured to convey a sheet in a first direction while being in contact with a first surface of the sheet;

a second roller configured to face the first roller and contact with a second surface the sheet in a state of sandwiching the sheet between the second roller and the first roller;

a torque limiter configured to impart an anti-torque to the second roller in order to generate a force on the second surface of the sheet in a direction opposite to the first direction;

a holder configured to rotatably support the second roller; and a driver configured to move the holder and bias the holder toward the first roller, wherein the driver comprises a moving mechanism that moves the holder, and a biasing member that biases the holder toward the first roller, wherein the moving mechanism rotates the holder around a first rotation shaft to move the holder, and wherein the first rotation shaft is coaxial with a rotation shaft of the second roller.

3. The sheet feed device according to claim 2, wherein the moving mechanism comprises a cam in which a first portion is configured to rotate around the first rotation shaft, a shaft that has a length in a second direction intersecting the first direction and rotates around the first rotation shaft together with the cam, and a motor that rotates the cam around the first rotation shaft, and the holder rotates around the shaft.

4. The sheet feed device according to claim 3, wherein the motor comprises a driving shaft which is fitted to a side surface of the cam and rotates the cam around the first rotation shaft.

5. A sheet feed device, comprising:

a first roller configured to convey a sheet in a first direction while being in contact with a first surface of the sheet;

a second roller configured to face the first roller and contact with a second surface the sheet in a state of sandwiching the sheet between the second roller and the first roller;

a torque limiter configured to impart an anti-torque to the second roller in order to generate a force on the second surface of the sheet in a direction opposite to the first direction;

a holder configured to rotatably support the second roller; and a driver configured to move the holder and bias the holder toward the first roller, wherein the driver comprises a moving mechanism that moves the holder, and a biasing member that biases the holder toward the first roller, wherein the moving mechanism rotates the holder around a first rotation shaft to move the holder, and wherein when an angle formed between a line connecting a second rotation shaft to which the holder is rotatably connected and a nip between the first roller and the second roller and the first direction is set to be a fulcrum angle, a humidity sensor configured to detect the humidity; and a controller configured to rotate and move the holder by the driver so that the fulcrum angle becomes smaller when a detection result obtained by the humidity sensor exceeds a humidity threshold value.

6. A sheet feed device, comprising:

a first roller configured to convey a sheet in a first direction while being in contact with a first surface of the sheet;

a second roller configured to face the first roller and contact with a second surface the sheet in a state of sandwiching the sheet between the second roller and the first roller;

a torque limiter configured to impart an anti-torque to the second roller in order to generate a force on the second surface of the sheet in a direction opposite to the first direction;

a holder configured to rotatably support the second roller; and a driver configured to move the holder and bias the holder toward the first roller, wherein the driver comprises a moving mechanism that moves the holder, and a biasing member that biases the holder toward the first roller, wherein the moving mechanism rotates the holder around a first rotation shaft to move the holder, and wherein when an angle formed between a line connecting a second rotation shaft to which the holder is rotatably connected and a nip between the first roller and the second roller and the first direction is set to be a fulcrum angle, a mass sensor configured to detect a mass of the sheet; and a controller configured to rotate and move the holder by the driver so that the fulcrum angle becomes larger when the detection result obtained by the mass sensor exceeds a mass threshold value.

7. An image forming apparatus, comprising:
an image forming device; and
a sheet feed device, comprising:
a first roller configured to convey a sheet in a first direction while being in contact with a first surface of the sheet;
a second roller configured to face the first roller and contact with a second surface the sheet in a state of sandwiching the sheet between the second roller and the first roller;
a torque limiter configured to impart an anti-torque to the second roller in order to generate a force on the second surface of the sheet in a direction opposite to the first direction;
a holder configured to rotatably support the second roller; and
a driver configured to move the holder and bias the holder toward the first roller;
wherein the driver comprises a moving mechanism that moves the holder, and a biasing member that biases the holder toward the first roller
wherein the moving mechanism rotates the holder around a first rotation shaft to move the holder, and wherein the first rotation shaft is positioned on a reference surface comprising a rotation shaft of the first roller and a rotation shaft of the second roller.

8. The image forming apparatus according to claim 7, wherein
the first rotation shaft is coaxial with a rotation shaft of the second roller.

9. The image forming apparatus according to claim 7, wherein
the moving mechanism comprises
a cam in which a first portion is configured to rotate around the first rotation shaft,
a shaft that has a length in a second direction intersecting the first direction and rotates around the first rotation shaft together with the cam, and
a motor that rotates the cam around the first rotation shaft, and
the holder rotates around the shaft.

10. The image forming apparatus according to claim 7, wherein
the motor comprises a driving shaft which is fitted to a side surface of the cam and rotates the cam around the first rotation shaft.

11. The image forming apparatus according to claim 7, further comprising:
when an angle formed between a line connecting a second rotation shaft to which the holder is rotatably connected and a nip between the first roller and the second roller and the first direction is set to be a fulcrum angle,
a humidity sensor configured to detect the humidity; and
a controller configured to rotate and move the holder by the driver so that the fulcrum angle becomes smaller when a detection result obtained by the humidity sensor exceeds a humidity threshold value.

12. The image forming apparatus according to claim 7, further comprising:
when an angle formed between a line connecting a second rotation shaft to which the holder is rotatably connected and a nip between the first roller and the second roller and the first direction is set to be a fulcrum angle,
a mass sensor configured to detect a mass of the sheet; and
a controller configured to rotate and move the holder by the driver so that the fulcrum angle becomes larger when the detection result obtained by the mass sensor exceeds a mass threshold value.

* * * * *